United States Patent [19]

Abel

[11] Patent Number: 4,593,905

[45] Date of Patent: Jun. 10, 1986

[54] RACQUET STRINGING SYSTEM WITH STRING TENSION INDICATING MEANS

[76] Inventor: Jack Abel, 1100 NW. 20 Ave., Delray Beach, Fla. 33445

[21] Appl. No.: 574,368

[22] Filed: Jan. 27, 1984

[51] Int. Cl.[4] ..... A63B 51/12

[52] U.S. Cl. ..... 273/73 D; 273/73 E; 273/73 A; 273/73 B

[58] Field of Search ..... 273/73 D, 73 E, 73 R; 84/312 R, 197, 198, 199

[56] References Cited

U.S. PATENT DOCUMENTS

| | | | |
|---|---|---|---|
| 2,089,118 | 8/1937 | Fritsch | 273/73 E |
| 2,165,701 | 7/1939 | Goerke | 273/73 E |
| 3,994,495 | 11/1976 | Stoffel | 273/73 D X |
| 4,005,863 | 2/1977 | Henry | 273/73 D |
| 4,026,553 | 5/1977 | Vendramini | 273/73 E |
| 4,118,029 | 10/1978 | Septier | 273/73 D |
| 4,130,045 | 12/1978 | Walker | 84/312 R X |
| 4,140,316 | 2/1979 | Coupar | 273/73 A |
| 4,309,033 | 1/1982 | Parker et al. | 273/73 D |
| 4,320,900 | 3/1982 | Blackburne | 273/73 D |
| 4,330,132 | 5/1982 | Ferrari | 273/73 D |
| 4,333,649 | 6/1982 | Vaughn et al. | 273/73 D |
| 4,349,198 | 9/1982 | Steick | 273/73 D |

FOREIGN PATENT DOCUMENTS

| | | | |
|---|---|---|---|
| 855446 | 2/1940 | France | 273/73 D |
| 498430 | 1/1939 | United Kingdom | 273/73 D |
| 887526 | 1/1962 | United Kingdom | 273/73 D |

*Primary Examiner*—Richard C. Pinkham
*Assistant Examiner*—Matthew L. Schneider
*Attorney, Agent, or Firm*—Albert F. Kronman

[57] ABSTRACT

A racket having strings strung across the head portion of the frame in which the strings have threaded end portions for engagement with correspondingly threaded nuts. Additionally, the threaded portion of the string can extend the entire length of the string so as to provide the string with a surface that imparts more spin to the ball. The surface of the strings is also provided with markings. When the string is tensioned in the frame through turning of the nuts, the distance between markings is increased due to elongation of the string. This elongation can be translated into a particular increase in tension by use of a suitably calibrated scale.

9 Claims, 14 Drawing Figures

TABLE 1

TABLE OF CORRECTED LOADINGS FOR RACQUET STRINGS USING NYLON STRING A, 40 THREADS PER INCH, 0.016" STRETCH PER INCH LONG PER 10-POUND LOAD.

EXAMPLE: SHORTEST CENTER CROSS-STRING LENGTH IS 8"

$\left(\frac{50\#}{8''} = 6.25 \text{ BASE LOAD}\right)$

| CONVENTIONAL LOADING | | | | 40 | 50 | 60 | 70 | 80 |
|---|---|---|---|---|---|---|---|---|
| STRING # | | SHORT LENGTH | LOAD PER IN. OF LENGTH | 5.0 | 6.25 | 7.5 | 8.75 | 10.0 |
| LEFT & RIGHT | 0 0 | 8" | | 40 | 50 | 60 | 70 | 80 |
| | 1 1 | 7 7/8" | | 39.4 | 49.2 | 59.1 | 68.9 | 78.8 |
| | 2 2 | 7 3/4" | | 38.8 | 48.4 | 58.1 | 67.8 | 75.0 |
| AS PER FIG.1 | 3 3 | 7 5/8" | *CORRECTED LOAD | 38.1 | 47.7 | 57.2 | 66.7 | 76.3 |
| | 4 4 | 7 3/8" | | 36.9 | 46.1 | 55.3 | 64.5 | 73.8 |
| | 5 5 | 7 3/16" | | 35.9 | 44.9 | 53.9 | 62.9 | 71.9 |
| | 6 6 | 6 7/8" | | 34.3 | 43.0 | 51.6 | 60.2 | 68.8 |
| | 7 7 | 6 3/8" | | 31.9 | 39.8 | 47.8 | 55.8 | 63.8 |
| | | | | | | | | |
| STRING # | | LONG LENGTH | LOAD PER IN. OF LENGTH | 5.0 | 6.25 | 7.5 | 8.75 | 10.0 |
| LEFT & RIGHT | 0 0 | 11" | | 55.0 | 68.8 | 82.5 | 96.2 | 110.0 |
| | 1 1 | 10 3/4" | | 53.8 | 67.2 | 80.6 | 94.1 | 107.5 |
| AS PER FIG.1 | 2 2 | 10 5/8" | *CORRECTED LOAD | 53.1 | 66.4 | 79.7 | 93.0 | 106.3 |
| | 3 3 | 10 1/4" | | 51.3 | 64.1 | 76.9 | 89.7 | 102.5 |
| | 4 4 | 9 3/4" | | 48.8 | 60.9 | 73.1 | 85.3 | 97.5 |

*CORRECTED LOAD = LOAD PER INCH OF LENGTH X LENGTH

FIG.14

RACQUET STRINGING SYSTEM WITH STRING TENSION INDICATING MEANS

BACKGROUND OF THE INVENTION

This invention relates to a racquet string and stringing system for tennis racquets, badminton racquets, squash racquets and similar sporting equipment wherein a relatively rigid frame is provided with a web held at a relatively high tension. In order to insure that the tension on the racquet strings is at the player's desired degree, players must rely on the feel of the strings, which is unreliable. Tournament competitors have several racquets strung at the same time so that they can change racquets during a match if a string is broken or if the use of the racquet in the game causes loosening of the string. The vast majority of players do not quickly notice loosening of the string and continue to use a racquet until the stringing is so far below the desired tension that it substantially interferes with their game. The racquet is then restrung by someone having the necessary experience or equipment to give the stringing the desired tension.

A further problem with conventional stringing is that when a single string breaks, particularly in those instances where the stringing consists of a single length of gut, plastic filament, wire or the like, the entire web loosens quickly, requiring complete restringing for satisfactory play.

To remedy this drawback, it has been known to use stringing in racquets in the form of individual lengths of string made of gut, plastic filaments, wire or rods. Such devices, however, have employed fastening means at the ends of the strings which substantially reduce the strength of the stringing and therefore shorten the useful life of the web. Other prior art stringing uses a knot at one or both ends of the string which also reduces the strength of the string. Still other prior art devices require substantial modification to the racquet frame resulting in unacceptable increases in weight.

Research leading to this invention indicates that the common practice of tensing strings of varying lengths with a fixed loading reduces the effectiveness, power and control in the games of tennis and the like. The invention, therefore, includes the following improvements:

I. Means are provided to tense or load strings according to their length and provide a simultaneous and uniform reaction tension on all the effective strings at the center of percussion.

II. Means also are provided to easily measure the loading and tension of the strings at all times.

III. Means further are provided for easy replacement of one or more strings without affecting the others.

IV. Means are provided for aging and stabilizing a strung and tensed racquet to improve and make more reliable its function in critical professional, as well as amateur, playing.

V. Means are provided for locking strings under tension which eliminate excess parts, excess weight and weakening of strings by clamping or knotting, etc.

VI. Means are provided to better control the ball without objectional flares, tails, springs, etc. The racquet is tensed like a fine tuned instrument and acts accordingly.

VII. Means are provided for easy reading of string tension with a tension gage having an attached magnifying lens.

VIII. Means are provided for a direct readout of string tension on the dial of an indicator in units of five pounds pull by attaching the indicator to the gage.

To achieve the above improvements, it is an object of the present invention to provide strings for racquets which have markings thereon to give immediate visual notice of the strings' loosening or longitudinal movement.

Another object of the present invention is to provide relatively inexpensive racquet strings which can be individually inserted, removed, tightened or loosened by the average player.

A further object of the invention is to provide a racquet string which can be individually adjusted so that certain areas of the web will have different tensions than others as desired by each player.

Still another object of the present invention is to provide a continuously threaded, moulded or extruded string for racquets which can be inserted, tensioned or loosened in the field, quickly, accurately and without need for large expensive stringing equipment.

BRIEF DESCRIPTION OF THE DRAWINGS

In the accompanying drawings forming part hereof, similar parts have been given the same reference numerals, in which drawings:

FIG. 14 is a chart showing corrected loadings for racket strings, useful in the present invention.

DETAILED DESCRIPTION

Figure 1:
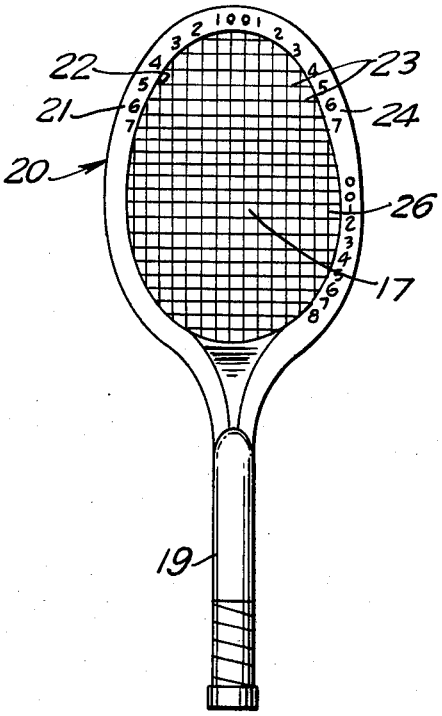
FIG. 1 is a view in elevation of a racquet strung in accordance with one embodiment of the present invention. with markings on the strings to identify each string, particularly in the "sweet spot".

Referring to the drawings and particularly to FIGS. 1–5, there is shown a tennis racquet 20, having a substantially rigid frame 21 made of wood, fiberglass, graphite, metal or combinations thereof such as is well-known in the art. The frame has a head portion 24 and a handle 19. The head 24 is provided with a plurality of transverse spaced bores 22 aligned around the head to position the strings 23 in the desired vertical and horizontal orientation. The strings may be inserted in the usual basket weave pattern to prevent movement out of their normal alignment and to form a web 26. The racquet may be of conventional size as in U.S. Pat. No. 1,539,019 or oversize as in U.S. Pat. No. 3,999,756. The strings 23 useful in the present invention may be made of any suitable material such as animal gut, nylon, steel, wire, wire reinforced nylon, or other plastic materials. The web is made up of lengths of string which terminate in opposed matching bores 22 in the frame head 24.

In the simplest embodiment of the invention, the racquet is strung conventionally to desired tension. Then markings 25 are made on the strings midway between the longitudinal and the cross-strings at least in the area of the center of percussion or "sweet spot" 17 which is located at or proximate to the geometrical center of the playing surface or web 26. The markings 25 can be applied in any convenient way. Suitably, they can be applied be stenciling and masking the midpoints between the strings. This method has been used in this art to identify the trade names of strings. It is evident that when the markings move from the midpoints of intersecting strings, the tension has decreased. The markings constitute "fingerprints" for the tension and enable a player to verify changes based on fact and not on feel. For convenience in viewing the markings may be of alternate colors.

Figure 2:
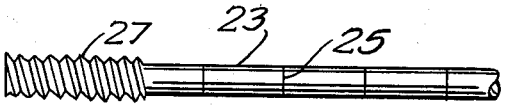
FIG. 2 is a view in elevation of a racquet string with spaced annular markings imprinted thereon somewhat enlarged.
Figure 7:
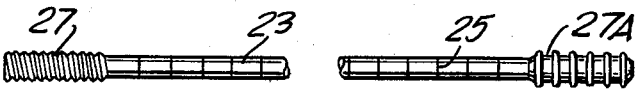
FIG. 7 is a view in elevation of a threaded racquet string with molded threads or annular ridges thereon.
Figure 8:
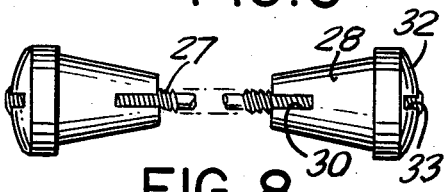
FIG. 8 is a view in side elevation showing the string retaining nut in place upon the ends of a string.

In the preferred embodiment of the invention, each string 23 is externally threaded at least in the outer portions of its length as indicated at 27 in FIGS. 2, 7 and 8. Where the player finds the threaded surface of the strings 23 improves his control of the ball, the threads 27 can continue for the full length of the string. If the player prefers the conventional surface, the strings may be threaded only adjacent the outer ends as shown in FIG. 8, for tightening and string retention purposes. It is possible with the present invention to combine totally and partially threaded strings in the same racquet to achieve a wide variety of racquet performances.

The threads on the strings must be formed in such manner that they will not reduce string tensile strength or durability or affect the ball undersirably. Accordingly, it is preferred to mould the threads as integral portions of the strings rather than cut the threads into a preformed string. Alternately, the threads may be rolled into the surface of an enlarged portion at each end of the strings provided the root diameter of the threads is not less than the outside diameter of the string. By way of illustration, but not limitation, the string, if made of nylon, may have an outside diameter of 0.060 inch and the thread an outside diameter of 0.085 inch with a root diameter no less than 0.060 inch.

It is within the purview of the present invention to use "v" threads, rolled threads, buttress threads or any other well-known thread forms on the strings, provided the pitch is sufficiently fine to give sufficient bearing surface to securely retain the string at the desired tension and under playing conditions. Three to five thread turns would be sufficient for this purpose.

In order to engage the threads 27 there are provided small internally threaded nuts 28, best shown in FIGS. 3–6 and 8. The nuts are frusto-conical in shape and are received within a tapered portion 29 of the bores 22. The nuts may also be slotted as shown at 30 in FIGS. 3, 5 and 8. The tapered portion 29 of each bore 22 can be slightly steeper than that of the outer surface of the nut, the nut will act as a chuck and firmly grasp the threaded ends 27 of the string as the nut is advanced from the position shown in FIG. 3 to that of FIG. 4. The nut is tightened upon the string by means of a spanner (not shown) which engages a slot 31 in the wider end of the nut.

Figure 4:
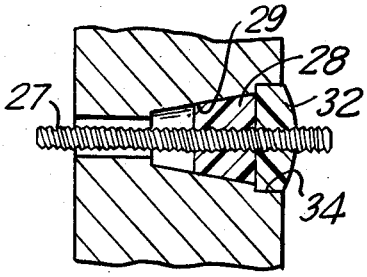
FIG. 4 is a view similar to FIG. 3 in the locked position.
Figure 5:
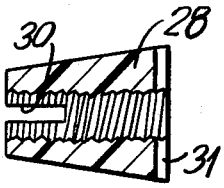
FIG. 5 is a longitudinal cross-sectional view of a nut for holding the tensioned string.
Figure 6:
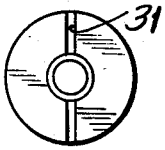
FIG. 6 is an end view of the nut shown in FIG. 5.

A small decorative lock nut 32 can, if desired, complete the string securing assembly. The lock nut 32 is also provided with a tightening slot 33 and is threaded upon the string 23 as shown in FIG. 4. The lock nut 32 is substantially received within an enlarged portion 34 at the outer end of the bore 22 and bears against the slotted end of the nut 28 as shown in FIG. 4. Both the nuts and lock nuts are preferably made of a light weight metal such as aluminum or a hard plastic which are available with close to the strength of steel.

If desired, a series of spaced annular ridges **27*a* shown in FIG. 7, may be substituted for the threads 27** and the nuts modified to engage said ridges for tightening purposes in the well-known manner.

When it is desired to string a racquet for the first time, a suitably bored frame is selected and the threaded end of the first string slipped through the bore 22 from the inside of the racquet. A nut 28 is threaded upon the outer string end and the string is then pulled to draw the nut tightly into the tapered portion of the bore 22. The lock nut 32 is next tightened into place. At this juncture the string, if threaded for its full length, may be cut to the length required to traverse the head of the racquet and extend a short distance beyond the frame. Alternately, the threaded end may be slipped through the bore 22 from the outside of the head on one side and pulled across the head of the frame and thrust through the complementary or aligned bore on the outer side. Where the threads are only formed at each end as individual strings, they need no cutting at this time.

Figure 3:
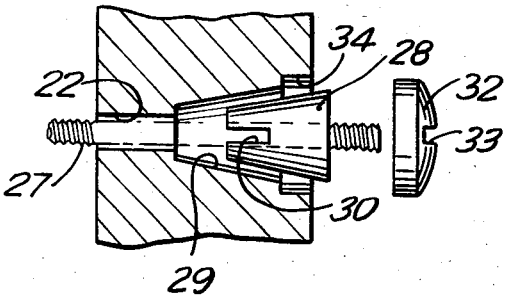
FIG. 3 is an enlarged, fragmentary, somewhat exploded view, partly in section of string securing elements of the present invention, according to one embodiment.

A second nut is next threaded upon the free end of the string which extends through the bore 22 as shown in FIG. 3. The lock nut 32 may also be loosely threaded upon the string. The string is then ready for tightening.

Figure 9:
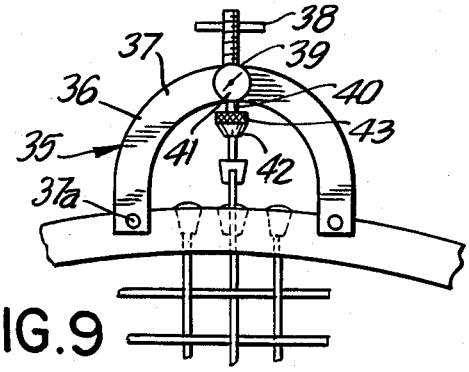
FIGS. 9 and 10 are fragmentary views showing two forms of string tensioning devices according to the present invention.
Figure 10:
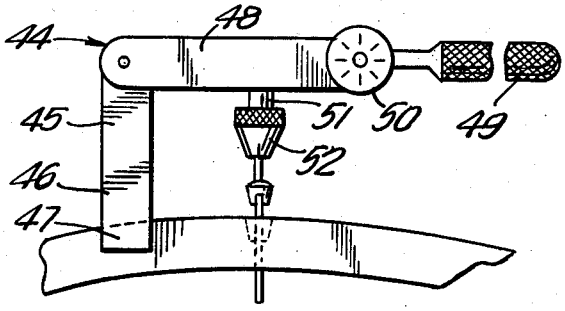

The proper tension is given the string 23 by means of suitable devices 35, 44 such as are shown in FIGS. 9 and 10.

The tensioning device 35 of FIG. 9 consists of an arcuate body 36 having racquet frame engaging end portions 37. A handle and threaded shaft 38 is received within a threaded bore 39 in the body portion 36. The end of the handle shaft is coupled to a chuck shaft 40 by way of a tension gage 41 supported by the body portion 36. A small chuck 42 on the end of the shaft 40 has internally threaded jaws (not shown) corresponding in shape and pitch to the threads on the string. When the knurled nut 43 is rotated, the jaws are tightened about the free end of the string as shown in FIG. 9. The chuck 42 also keeps strings from turning. The handle and shaft 38 are then rotated until the desired tension is shown on the gage 41. The nut 28 is then rotated upon the string until it reaches the position shown in FIG. 4 within the bore 22. The lock nut 32 may also then be rotated on the string until it bears against the nut. The chuck 42 may then be opened and any excess string projecting from the lock nut 32 cut off. Clamping screws **37*a* adjust for variations in frame width and serve to hold tensioning device 35** in place.

The tensioning device 44 shown in FIG. 10 operates in much the same manner as that shown and described in FIG. 9 except that the body portion 45 consists of a single vertical leg 46 having a forked frame engaging portion 47. An arm 48 is pivotally secured at one end to the vertical leg 46. A handle 49 is coupled to the free end of the arm by means of a tension measuring gage 50. The gage 50 may be similar in construction to those used in torque wrenches or contain clutch members which may be adjusted so that only that upward force required to produce any specific tension on the string will be applied to the string by way of the shaft 51 and chuck 52 carried by the arm 48.

It will be seen that the tensioning force of the devices shown in FIGS. 9 and 10 is in line with the longitudinal axis of the string. Moreover, the nuts holding the strings in place by reason of the axial location of the strings within the nuts and the large thread bearing surfaces between the string threads and the internal nut thread surfaces all cooperate to prevent damage or impose usefull lifeshortening forces upon the string.

Successive strings are applied to the racquet head by repeating the above steps. Where required the strings are wover across intersecting strings as is well-known in the tennis racquet art.

When one or more strings break during play, they may be removed by pulling them out of the racquet head and replaced in the manner described above without disturbing the other strings.

The tension of any string or strings in a racquet may be verified at any time merely be backing off the lock nut 32, grasping the protruding end of the string 23 in the chuck of the tensioning device and reading the tension shown by the gages. If the string needs more tension, the necessary force may be applied and the nut advanced to its proper position within the bore 22. The lock nut, if needed, is then threaded upon the projecting end of the string.

From the foregoing it will be seen that there has been provided racquet string and fastening means which permit individual tension control on racquet strings and is simple and inexpensive in construction. Precise tensioning is afforded by the disclosed structure as well as measurement of the tension on individual strings. Strings can be replaced in the field and properly tensioned by simple apparatus and strings need not be uniform in tension over the entire racquet, as later explained herein. Since discrete lengths of string may be substituted, when a single string breaks, it will not loosen the entire web.

Figure 11:
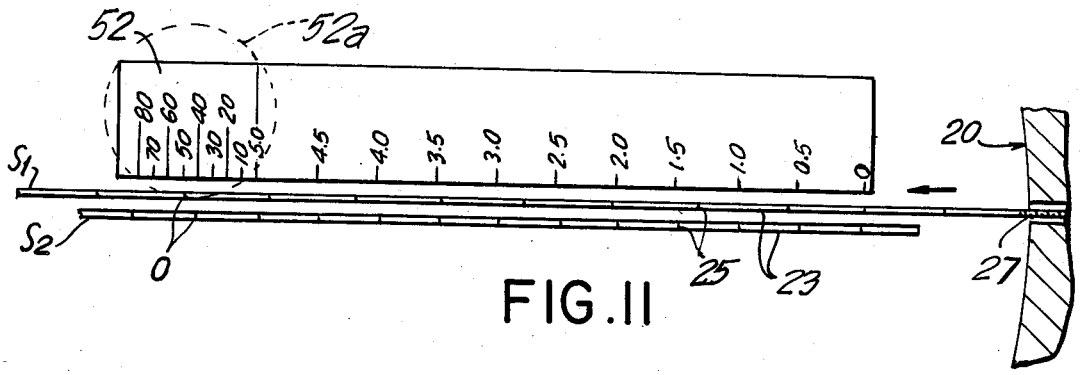
FIG. 11 is a top plan view of a simple tension measuring gage and its application with tensed and not-tensed strings.
Figure 12:
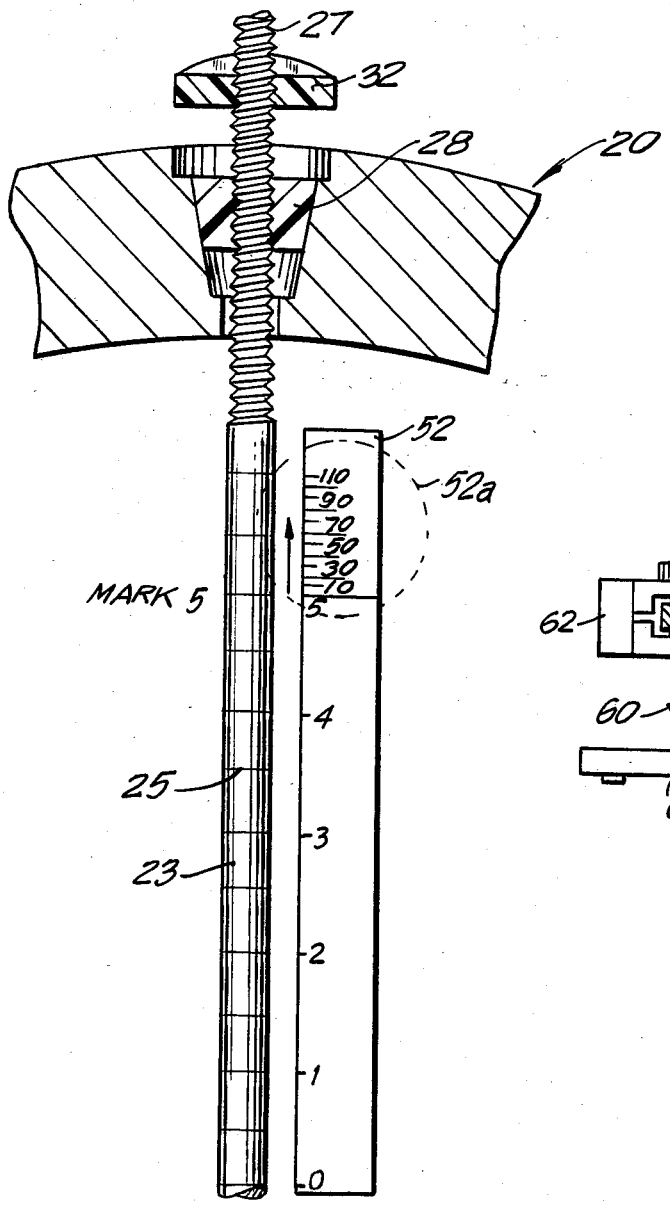
FIG. 12 is an enlarged view, partly in section, of the string, frame and tension gage in use.

A suitable string extension measuring device 52 is shown in FIG. 11. The extension measuring device is in the form of a 6" metal rule, with a magnifier 52 as indicated in FIG. 12. The rule has ½" spaced markings for the first five inches of its length. The last inch is marked with spacings equivalent to the stretch per five-inch length of the string per ten pound load and is marked in ten pound intervals as 0-10-20-30-40-50-60-70-80. A single rule can have four different string equivalent markings on each of two sides and two margins. Use of string extension measuring device 52 is evident from FIGS. 11–13 and FIG. 14.

FIG. 11 shows the device 52 measuring tension on strings $S_1$ and $S_2$. $S_1$ is a short string (8 inches long) tensed in the direction on the arrow in racket 20 under 50 pounds of tension. As shown, the 50 pound mark on the rule 52 lines up with the origin "0" mark on the string five inches from its end. $S_2$ is the same string when not tensed and all half-inch markings 25 coincide with the half-inch markings (0, 0.5, 1.0, etc). on the rule.

If the markings on the string and rule show that the tension is too high or too low, the devices in FIG. 9 or FIG. 10 may be used in the manner described above. If after three or four such adjustments with the racquet in use, the string appears to have been overstretched beyond its elastic limit, the string should be replaced. This is much less costly and more efficient than waiting and restring the racquet by the old method.

This inventor's research and testing indicated that the present common practice of tensing strings of varying lengths with a fixed loading reduces the effectiveness, power and control in racket games. When tennis strings are tensed by a fixed weight or force, this serves well to apply a fixed load of, for example, 50 pounds to the racquet strings but since the strings vary in length, and since the effective push on the ball depends on the tension in pounds per inch of length of that string, it is necessary to adjust the loading to the string length in order to provide uniform and simultaneous thrust to the ball.

EXAMPLE

Starting with the central shortest horizontal strings, which are 8" lengths, at fifty pounds; 50/8=6.25 pounds per inch of length are obtained. Since the central long (longitudinal) strings are 11", then we get 50/11=4.5 pounds per inch length. To obtain 6.25 pounds per inch, we need a loading of 68.8 pounds. Then, both the long and short strings will be under the same tension and will act simultaneously to give a greater impetus to the ball with no more effort by the player, plus more uniform control as well. It will also maximize the effectiveness of the player's skill and power as applied to the racquet.

Each string that is involved in the so-called "sweet spot" can have its loading determined by its length (see FIG. 14). A suitable table of the proper loading can be made (FIG. 14) which will serve for any given racquet with its string. Of course, for this table, individual strings must be used, except for the outer strings which are those within 2' to 2¼" from the frame. These can still be strung by the old continuous string and fixed load method and serve to stabilize the frame. Existing tensioning and stringing machines may still be used if the loading is adjusted as per FIG. 14. The chart can now be set up for the initial loading by identifying the "sweet spot" strings (see FIG. 1), measuring their lengths and multiplying by the base factor 40, 50, 60, etc. as preferred/length of short center string as 50/8=6.25.

In one example of the invention, a player requested a fifty pound conventional load. The short center cross-string (0,0) was 8" long: 50/8=6.25 pounds per inch of length of string. The figures under 50 pound times length gives the corrected load in FIG. 14.

Other players requesting other conventional loads will produce a different base load factor also calculated on the basis of the pounds per inch of length of the shortest cross-string.

The correct gage for the string must be used to obtain tension readings.

Figure 13:
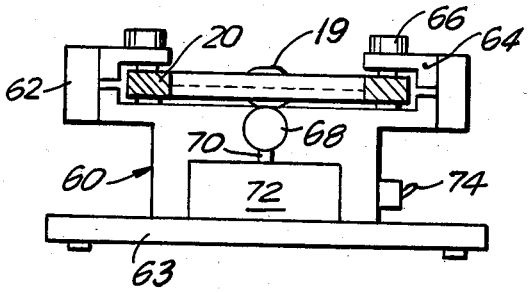
FIG. 13 is a front elevational view of a tensed string stabilizer device to set the strings and provide longer use between retensing and/or restringing.

Stringing should be aged or stabilized by either hand playing or by a tennis racquet stabilizing machine such as that shown in FIG. 13. Observation and experience indicate that a newly strung or long hard-played racquet needs stabilizing to give reliable results in play.

A ball-hitting racquet stabilizing machine 60 is shown in FIG. 13. This machine comprises holder 62 on frame 63 for racquet 20, handle is reference 19. A vise arrangement 64, including holding screws 66, holds the racquet 20 in place against a ball 68 which is attached to a reciprocating arm 70 which has an adjustable stroke and length-adjustable or telescopic means for adjusting the ball position against different centers of percussion of different sizes of racquets. The arm is actuated by a timer motor 72 operated by switch 74.

The racquet is first tensed and gaged and placed in the machine 60, which in effect repeatedly hits it with the ball 68 for a desired period of time.

A string suitable for the present invention can be inexpensively made in a continuous process on a reel with rolled threads and half-inch spaced markings. Annular ridges can substitute for the threads, but are a second choice. It is important that the root diameter of the threads be no smaller than the outside diameter of a string conventionally used.

The rolled thread or ridges 27 have no sharp edges and surfaces are not cut to shape, but are smooth and continuous with generous fillets and radii as shown.

Having thus fully described the invention, what is desired to be claimed and secured by Letters Patent is:

1. A racquet and string assembly comprising a frame, a head portion and a handle portion on said frame, a plurality of opposed spaced bores traversing the head portion, enlarged recessed portions at the outer ends of each of said bores, a plurality of spaced individual strings of substantially uniform outside diameter secured at each end thereof within the bores and disposed vertically and horizontally across the racquet head to form a web, outwardly extending string securing thread means integral with said strings on at least the ends thereof, at least some of said strings having a series of spaced markings thereon whereby tension applied to said strings will increase the distance between said markings so as to provide a means for measuring the tension in said strings, said markings being located at least on those portions of the strings that form the geometrical center of said web, and internally threaded string retaining means threadably engagable with the string securing means and receivable within the enlarged recessed portions of the racquet bores to hold the strings at a desired tension without reducing the outside diameter of said strings.

2. An assembly according to claim 1 in which the outwardly extending string securing means comprises an external thread extending the entire length of said string.

3. An assembly according to claim 1 in which the string securing means is formed inwardly of each end of the string and has an outside diameter greater than the outside diameter of the string.

4. An assembly according to claim 3 in which the string securing means is a thread having a root diameter no less than the outside diameter of the string.

5. An assembly according to claim 3 in which the string securing means is a series of spaced annular ridges.

6. An assembly according to claim 1 in which the markings are separated by a space of the order of ½ inch.

7. An assembly according to claim 1 in which the markings are in the form of spaced lines normal to the longitudinal axis of the strings.

8. An assembly according to claim 1 in which the string retaining means is a nut having a longitudinal internally threaded bore therein.

9. An assembly according to claim 8 in which the string retaining means further includes a lock nut.

* * * * *